United States Patent [19]

Meardi

[11] 4,000,623

[45] Jan. 4, 1977

[54] ANCHOR ROD FOR WALLS, BULKHEADS AND THE LIKE

[76] Inventor: Pietro Meardi, Via Battistotti Sassi, 29, 20133 Milan, Italy

[22] Filed: June 2, 1975

[21] Appl. No.: 582,785

[30] Foreign Application Priority Data

May 31, 1974 Italy ..... 23420/74

[52] U.S. Cl. ..... 61/39; 52/155; 52/230

[51] Int. Cl.[2] ..... E02D 5/38; E02D 5/54

[58] Field of Search ..... 61/39, 35, 45 B, 53, 61/52; 52/155, 230

[56] References Cited

UNITED STATES PATENTS

| | | | |
|---|---|---|---|
| 3,735,541 | 5/1973 | Vanderlinde | 61/39 |
| 3,738,071 | 6/1973 | Finsterwalder | 61/45 B X |
| 3,754,401 | 8/1973 | Lipow | 61/39 |
| 3,908,386 | 9/1975 | Williams | 61/35 |

*Primary Examiner*—Jacob Shapiro
*Attorney, Agent, or Firm*—Young & Thompson

[57] ABSTRACT

An anchor rod for supporting walls, bulkheads and the like, comprises: an anchoring body to be cemented to the ground, at the bottom of a hole for the rod, by burying it into a casting of cement mixture, forming therewith the anchor bulb of the rod; traction cables connecting said anchoring body to a head-piece being fixed to the wall or like to be supported; two pipes containing and protecting said cables inside said hole, the first of said pipes carrying centering members, distributed throughout its length, and an inflatable plugging sleeve close to its end opposite to the head-piece, while the second pipe is telescoped into the first one, in correspondence of the end; and one pipe for feeding said cement mixture to form said bulb. The anchoring body consists of a frustoconical element, connected with its minor base to the end of said second pipe and housing, at its major outer base, a connection plate for the traction cables, being crossed by the pipe for feeding the cement mixture.

9 Claims, 4 Drawing Figures

ANCHOR ROD FOR WALLS, BULKHEADS AND THE LIKE

BACKGROUND OF THE INVENTION

It is known that anchor rods are usually used for the support of walls, bulkheads and the like, being limitedly sunk into the ground or resting on loose ground, for example for the forming of scarps, especially in road and railway works.

Such rods are generally anchored, with their inner end, to the surrounding ground, at the bottom of a hole made into the ground for housing the rod itself, said rod end being buried in a casting of cement mixture, forming therewith an anchoring bulb. The same rods comprise, at their outer end, a head-piece for connection to the wall or like to be supported, and in correspondence of their intermediate portion, a number of free steel strands under tension, contained in a protection pipe. According to known technique, the inner end of such rods is formed by simply deforming with undulations the end parts of the strands, extending beyond the protection pipe as far as the bottom of the hole for the rod, and by fastening crosswise such deformed parts of the strands, so as to form a branched structure, adapted to efficiently engage with the casting of cement mixture, which is meant to embody it so as to form therewith the anchoring bulb of the rod.

In the setting up, after placing the rod inside the hole provided therefor, one forms the anchoring bulb by injecting cement mixture under pressure to the bottom of said hole, hence obtaining the anchoring of the rod to the ground, preferably a rocky soil. Subsequently, the free length of the strands is put under tension, by firmly connecting said strands to the outer head-piece of the rod, which is in turn fixed to the wall or like to be supported.

This system, generally adopted up to now, has drawbacks which are not negligible. In fact, when putting under tension the steel strands of the rod, in correspondence of their deep part which is buried in the hardened cement mixture with which they form the anchor bulb, such strands cause in such mixture, by adhesion, an elongation which is equal to the elongation of the actual strands. Said elongation is remarkable in the less deep part of the bulb, because of the high unitary stress in the strands, and this is hardly compatible with the characteristics of cement mixture. This easily causes the forming of more or less capillary crack in the anchor bulb, which crack are apt to let through any aggressive liquids which might eventually be present in the surrounding soil or rock. Even the bulb-rock adhesion force, which is initially exerted in the less deep part of the anchorage, often reaches its peak value, causing even in the rock, crack which reduce its resistance and facilitate the seepage of aggressive agents.

The cracks cause the depthwise extension of the adhesion stresses between the steel and the hardened cement mixture, and between the latter and the rock, and the whole bulb may hence fall apart, if it is of reduced length.

To eliminate the above drawback, anchor rods have been set up making use of steel bars, in replacement of the strands, said bars being placed in the area of the bulb, within a cylindrical metal body, and being screwed to the end of said body which is arranged at the bottom of the hole for the rod.

Also in this case, the anchor bulb is obtained by injecting cement mixture under pressure into the bottom of the hole. In this way, the pull of the bars is applied on the very end of the rod, widening the extension of the surface of actual adhesion to the rock, in correspondence of which there could be creeping of the bulb and settling of the surrounding ground, and creating a more favorable distribution of the stresses in the cement mixture of the bulb and in the contacting rock, which are compressed and not pulled. In this way, the above drawbacks are reduced, though not yet to a satisfactory extent.

SUMMARY OF THE INVENTION

The object of the present invention is to provide an anchor rod, adapted to eliminate the above drawbacks.

Said rod substantially comprises: two pipes containing and protecting the traction cables, the first of said pipes carrying centering members, distributed throughout its length, and an inflatable plugging sleeve close to its end opposite to the head-piece of the rod, while the second pipe is telescoped into the first one, in correspondence of said end; and an anchoring body consisting of a frustoconical element, connected with its minor base to the end of said second pipe and housing, at its major outer base, a connection plate for the traction cables, being crossed by the pipe feeding the cement mixture, this last pipe being arranged inside said pipes containing and protecting the cables, and extending beyond said frustoconical element.

Said rod is set up through the following stops a suitable hole is made in the ground; the rod is introduced therein; cement mixture is introduced, with a slight pressure, into the pipe feeding said mixture, up to filling the hole; the plugging sleeve is inflated; one waits for the setting up to plastic condition, of the cement mixture introduced; a first pulling of the cables is carried out, introducing simultaneously a further amount of cement mortar, at a pressure slightly higher than the previous one, but still reduced; when the setting is complete and the cement mixture is sufficiently hard, the pulling of the cables is carried out to the final condition.

BRIEF DESCRIPTION OF THE DRAWINGS

The accompanying drawings show schematically a preferred embodiment of the rod according to the present invention, and precisely.

DESCRIPTION OF THE PREFERRED EMBODIMENT

Figures 1, 4:
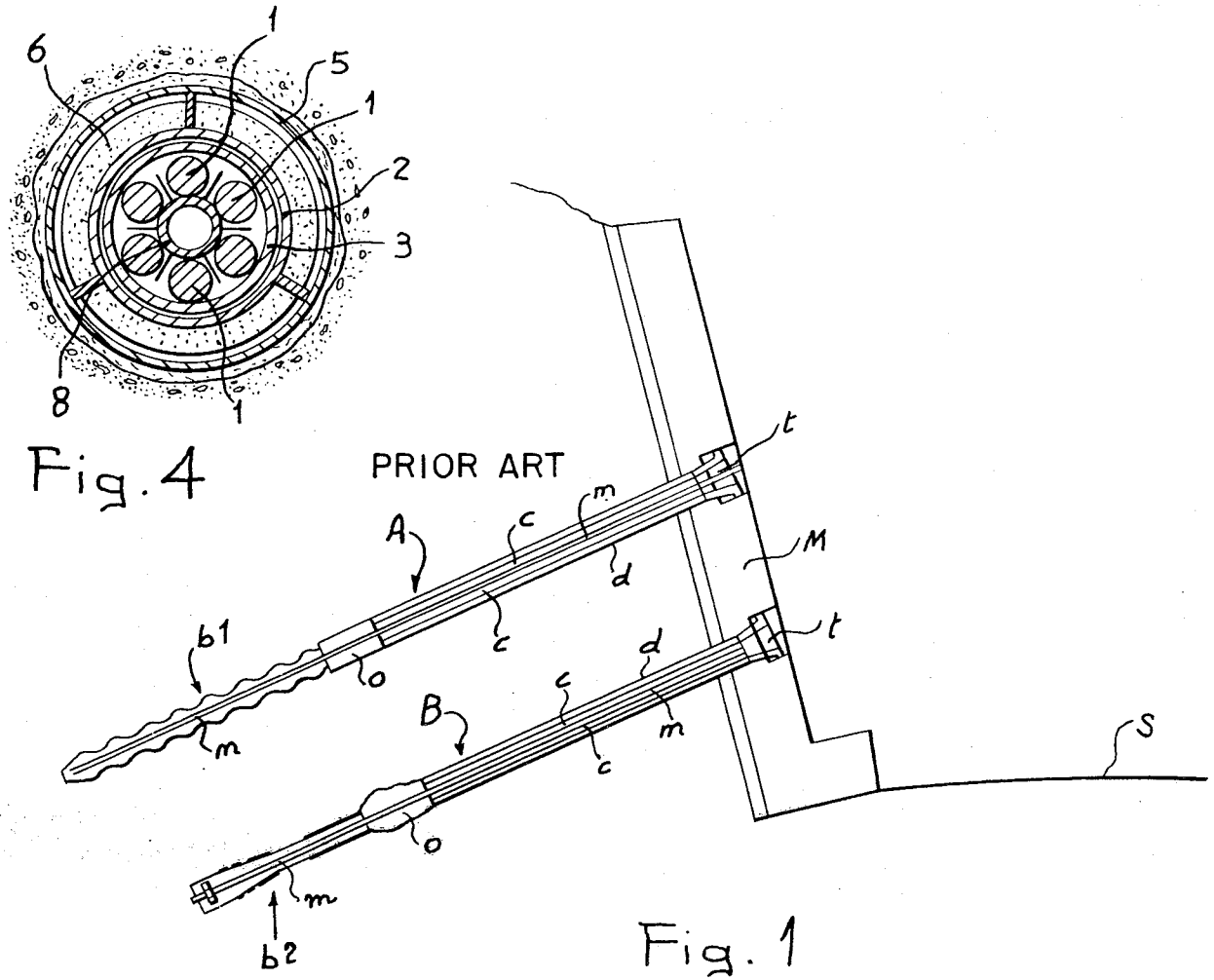
FIG. 1 is a reduced scale and very schematic view of two rods, one of known type and the other according to the invention, for anchoring a scarp retaining wall.
FIG. 4 is a crosswise section view of the same rod, on the line I—I of FIG. 2.

FIG. 1 of the accompanying drawings shows a known-type rod A and a rod B according to the present invention, being applied for supporting the scarp wall M of a road S. Both these rods comprise a head-piece *t* connected to the wall M, traction cables *c* sliding in a protection pipe *d*, a pipe *m* feeding the anchoring cement mixture, and a plugging sleeve *o*.

The known-type rod A terminates with an anchoring end *b*1, obtained by deforming and fastening crosswise the strands *c* coming out of the pipe *m*, as already explained further above, while the rod B according to the invention ends in a special anchoring body *b*2 of frustoconical shape; it moreover differs entirely from the rod A as to all its active part, comprised between said anchoring body and the plugging sleeve, and as to the plugging sleeve itself, as will be described in detail hereinafter.

Figure 2:
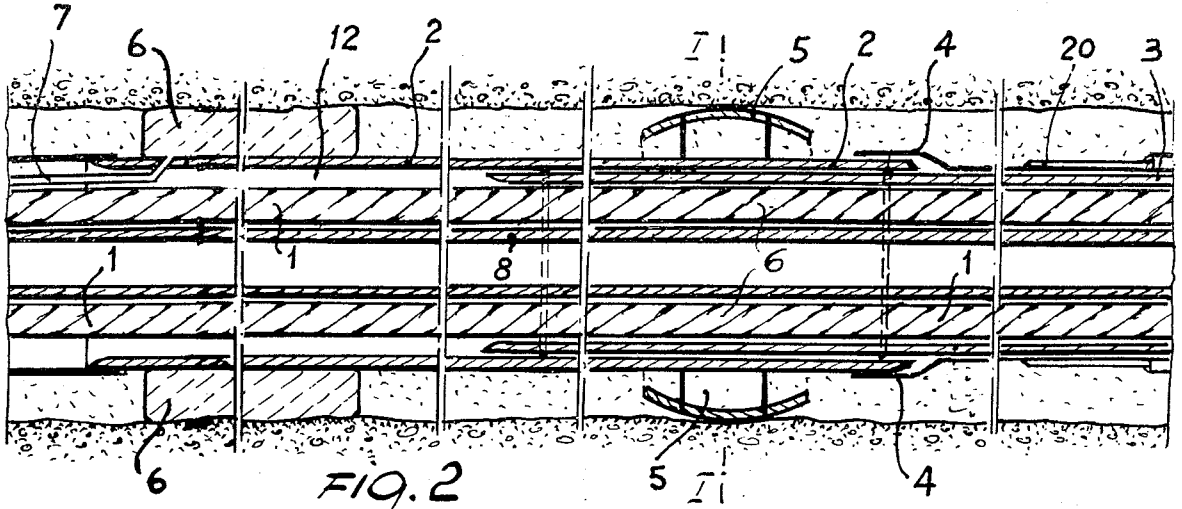
FIG. 2 is a longitudinal section veiw of the characteristic intermediate section of a rod according to the invention.

With reference to FIGS. 2 and 4, it may be seen that the traction cables 1 (usually steel strands) of the rod, are mounted — arranged like a crown — sliding inside two coaxial pipes 2 and 3, the first of said pipes forming the inner end part of the protection pipe *d* of FIG. 1, connected to the head-piece *t*, while the second pipe is connected to the end body *b*2. The pipe 3 is telescoped into the pipe 2, and is outwardly provided with a sealing sleeve 4, that encompasses the end of the pipe 2.

The pipe 2 comprises centering members 5 (FIGS. 2 and 4), adapted to place the pipe itself well centered inside the hole F, made in the ground for receiving the rod. The pipe 2 further comprises an inflatable plugging sleeve 6. While there are various centering members 5, appropriately spaced from each other along the pipe *d* (FIG. 1), there is only one plugging sleeve 6, which is placed at a short distance from the end of the pipe 2 (FIGS. 1 and 2): a tube 7, which can be arranged between the cables 1 and the pipe 2, is used to inflate said plugging sleeve.

Figure 3:
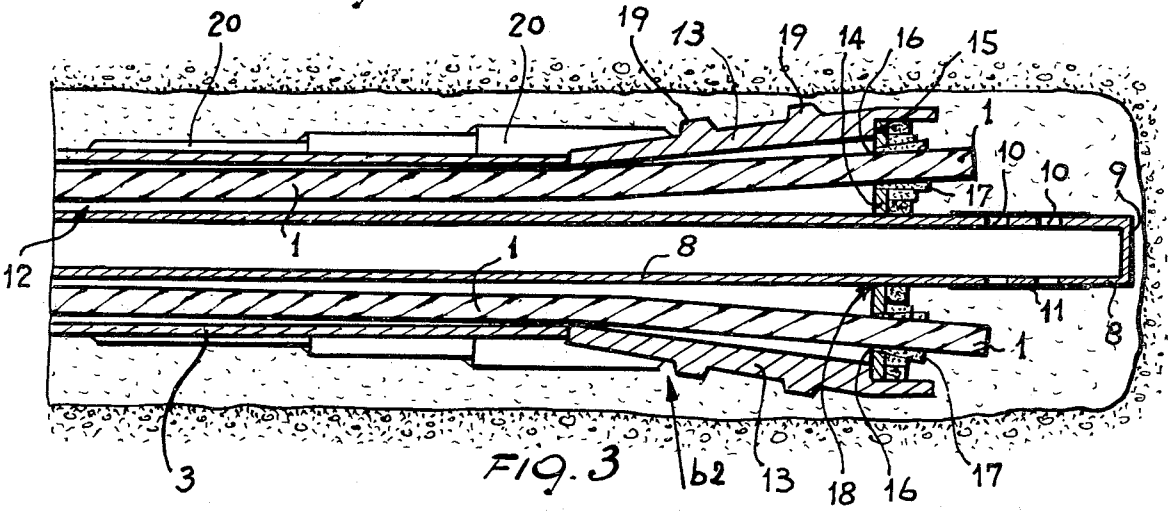
FIG. 3 is a detailed longitudinal section view of the anchoring body of the rod of FIG. 2.

The coaxial pipes 2 and 3 contain a further pipe 8 (FIGS. 2 to 4, corresponding to the pipe *m* of FIG. 1), which is arranged inside the crown of cables 1; said pipe 8 is used for feeding cement mixture to the bottom of the hole F, and extends beyond the end of the anchoring body *b*2. This end part or extension of the pipe 8, being closed at 9, comprises lateral holes 10, protected by a flexible sheath 11. Between the pipe 8 and the pipes 2 and 3, the traction cables 1 are immersed in a pasty substance 12, preferably grease, bitumen or other substance suitable for isolating and protecting the cables themselves. These may further be conveniently wrapped in a sheath of plastic material.

The anchoring body *b*2 of the rod according to the invention consists of a frustoconical element 13, having its minor base turned towards the end of the pipe 3, to which it is connected, usually by welding. The ends of the traction cables 1 are connected to the element 13: for this purpose, a circular plate 14 is provided, resting in a seat 15 against the major base of the frustoconical element 13. Said plate 14 is provided with holes 16, letting through the cables 1 which are then locked by traction by means of tapered sleeves 17. The same plate is further provided with a central hole 18, letting through the central pipe 8 for feeding the cement mixture.

The frustoconical element 13 is outwardly formed with circumferential projections 19, and its connection to the pipe 3 is completed by a stepped sheet-metal binding 20, extending the taper of the body *b*2 along the first part of the pipe 3 itself.

To set up the heretofore described rod according to the invention, it is first of all necessary to make a hole F in the ground, in a fully conventional way, the diameter of said hole being slightly greater than the diameter of the pipes 2, 3, and of the frustoconical element 13; the rod is then introduced, in such a manner as to arrange its frustoconical end *b*2 close to the bottom of the hole. Thanks to the centering members 5, provided along the pipe 2, the whole unit will be arranged substantially centred in the hole F. Cement mixture at slight pressure (for example, 2–3 atm.) is then introduced into the pipe 8. Said mixture, coming out of the holes 10 provided in the pipe 8, quickly invades the hole F, starting from the bottom thereof up to filling it, and only finds a very limited obstacle formed by the centering members 5, which leave wide passages free, and by the plugging sleeve 6, which is deflated.

When, after filling the hole F, the cement mixture comes out of its top, the plugging sleeve 6 is inflated, and sufficient time is allowed to pass for the cement mixture to set, up to reaching the plastic condition. At this stage, a first traction on the cables 1 is carried out, producing a limited plastic flow of the bulb and causing a fast, violent increase in the pressure allowing compaction and anchorage; this avoids having to resort — as often happens with the conventional anchor rods — to a high compression of the cement mixture being fed through the pipe 8, which compression may be dangerous for the stability of the ground surrounding the hole. At this stage, one takes the greatest advantage of the frustoconical shape of the end element 13 of the rod, which is such as to force the cement mixture against the walls of the hole, thereby increasing the slipping strength, through increase of the effective pressure against the soil. While carrying out the traction, one continues to introduce cement mixture at a higher pressure than previously, but still reduced (4, maximum 5 atm.), so as to fill any spaces which might have been created by the plastic flow of the bulb. Then, in due course, the traction on the cables may be carried out to final condition. All this procedure guarantees an extremely safe locking of the anchoring end of the rod. Should the slipping be very great (more unfavorable condition), the pipe 3 may be forced to slide into the pipe 2, up to when the latter engages the first step of the binding 20 of the pipe 3 itself: in this case, the rod behaves substantially as though comprising bars, with cylindrical end anchorage, but with the double advantage of having a frustoconical anchorage and of allowing the rod to be set up with the introduction of cement mixture at low pressure. As a rule, however, the slipping is more limited and the pipe 2 practically never reaches the binding 20, between the element 13 and the pipe 3. This means that, if one does not succeed in producing a further slippage of the rod end, the anchorage in the ground should, in this case, be considered as perfect. In fact, tests carried out have led to the breakage of iron tubes, simulating the hole, before the anchorage gave in.

A further important characteristic of the rod according to the invention concerns the particularly efficient protection of its more delicate parts, such as the cables 1, from injuries deriving from agents which might attack the metal parts of the conventional anchor rods. Said protection, in fact, is first of all provided by the hardened cement mixture, wrapping the pipes 2 and 3, and the frustoconical element 13. In the most delicate part of the rod, between the sleeve 6 and the bottom of the hole, said mixture is compact and impermeable, thanks to its nature and to the high compression to which it has always been subjected, since its setting and since the first traction stage, up to the final condition (while, in conventional rods, said mixture is highly subjected to traction, as seen further above); said mixture is hence adapted to efficiently repel any seepages of waters or other liquids, even corrosive. The above protection is further provided by the steel pipes 2 and 3 and by the frustoconical element 13, by the grease or other pasty material enveloping the cables, and finally, by the sheath of plastic material wrapping the cables themselves.

One should also not neglect the already indicated advantage of the rod according to the invention, deriving from the possibility to set up the rod by introducing the cement mixture at low pressure, which prevents — as seen hereabove — the considerable risks ensuing from the behaviour of the ground.

In all these respects, the invention constitutes a clear progress over the similar products and known techniques, and allows a much higher and longlasting safety in use, with obvious technical nd economic advantages. Moreover, said rod is generally of shorter length than the known-type rods.

It is understood that the described embodiment of the rod according to the invention is merely given by way of example and by no means limits the field of the invention, which may extend to other embodiments and modifications thereof, varying from the one heretofore illustrated. It should be noted, for example, that the frustoconical anchoring end body of the rod could be screwed, or otherwise connected to the inner pipe, instead of being welded thereto, as indicated above, or it could even be integral with said pipe. The same anchoring body could also have — instead of the frustoconical shape described herein — the structure of a large cylindrical plate, placed at the bottom of the inner pipe, as long as the latter — instead of consisting of a single pipe — were formed by the association of three or four telescoped pipe sections, forming a stepped unit (substantially frustoconical). All such modifications fall within the scope of the present invention.

I claim:

1. An anchor rod for supporting walls, bulkheads, and the like, and adapted to extend into an elongated hole in the ground and to be anchored in said hole, said rod comprising a central pipe that extends into the hole for feeding cement into the hole, a plurality of cables extending lengthwise of the hole and surrounding said central pipe, a pair of telescoping pipes surrounding said cables, one of said telescoping pipes being disposed adjacent the inner end of the hole and the other adjacent the outer end of the hole, an inflatable plugging sleeve on said other pipe, the ends of said cables within said hole being secured to said one telescoping pipe, said one telescoping pipe carrying a frustoconical element whose small end points in a direction out of the hole, and a headpiece fixed to the wall or the like to be supported, the other ends of said cables being connected to the headpiece for tightening the cables to draw said frusto-conical element in a direction out of the hole thereby to compress cement between said frusto-conical element and the inflatable sleeve.

2. An anchor rod as claimed in claim 1, said frustoconical element being connected by welding to the end of said one telescoping pipe which is deepest within the hole.

3. An anchor rod as claimed in claim 1, said cables being steel strands arranged in a crown within said telescoping pipes.

4. An anchor rod as claimed in claim 1, a first of said telescoping pipes extending within a second of said telescoping pipes, the first telescoping pipe having thereon a sleeve that surrounds the adjacent end of said second telescoping pipe.

5. An anchor rod as claimed in claim 1, said frustoconical element having circumferential projections thereon.

6. An anchor rod as claimed in claim 1, and a stepped sheet metal binding extending the taper of said frustoconical element along a short length of said other telescoping pipe.

7. An anchor rod as claimed in claim 1, and a tube extending within said telescoping pipes for inflating said inflatable sleeve.

8. An anchor rod as claimed in claim 1, said central pipe extending a short distance beyond said frustoconical element.

9. An anchor rod as claimed in claim 8, the inner end of said central pipe being closed, said central pipe having lateral holes therethrough adjacent its inner end, said holes being protected by a flexible sheath.

* * * * *